US005242613A

United States Patent [19]

Ozbalik et al.

[11] Patent Number: 5,242,613

[45] Date of Patent: Sep. 7, 1993

[54] PROCESS FOR MIXED EXTREME PRESSURE ADDITIVES

[75] Inventors: Nubar Ozbalik; Robert I. Davidson, both of Baton Rouge, La.

[73] Assignee: Ethyl Corporation, Richmond, Va.

[21] Appl. No.: 791,271

[22] Filed: Nov. 13, 1991

[51] Int. Cl.[5] ..... C10M 137/00; C10M 135/00

[52] U.S. Cl. ..... 252/46.7; 252/46.6

[58] Field of Search ..... 252/46.6, 46.7

[56] References Cited

U.S. PATENT DOCUMENTS

| | | | |
|---|---|---|---|
| 2,237,625 | 4/1941 | Olin | 260/125 |
| 2,558,221 | 6/1951 | Mertz et al. | 260/608 |
| 2,574,884 | 11/1951 | Mertz et al. | 260/608 |
| 3,022,351 | 2/1962 | Mihan et al. | 260/608 |
| 3,275,693 | 9/1966 | Bapseres et al. | 260/608 |
| 3,308,166 | 3/1967 | Biensan et al. | 260/608 |
| 3,314,999 | 4/1967 | Bapseres et al. | 260/608 |
| 3,340,324 | 9/1967 | Warner | 260/608 |
| 3,392,201 | 7/1968 | Warner | 260/608 |
| 3,452,100 | 6/1969 | Bennett et al. | 260/608 |
| 3,510,426 | 5/1970 | Papay | 252/46.6 |
| 3,583,915 | 6/1971 | Myers | 252/46.6 |
| 3,703,504 | 11/1972 | Horodysky | 260/139 |
| 3,703,505 | 11/1972 | Horodysky et al. | 260/139 |
| 3,755,461 | 8/1973 | Kvasnikoff et al. | 260/608 |
| 3,994,979 | 11/1976 | Warner | 260/608 |
| 4,152,275 | 5/1979 | Horodysky et al. | 252/46.6 |
| 4,207,195 | 6/1980 | Horodysky | 252/46.6 |
| 4,212,753 | 7/1980 | Horodysky | 252/46.7 |
| 4,277,623 | 7/1981 | Kubicek | 568/26 |
| 4,288,627 | 9/1981 | Kubicek | 568/26 |
| 4,564,709 | 1/1986 | Koyama et al. | 568/26 |
| 4,744,912 | 5/1988 | Cardis | 252/46.7 |
| 4,876,389 | 10/1989 | Gongora et al. | 568/26 |
| 4,900,460 | 2/1990 | Cardis | 252/46.6 |
| 4,933,481 | 6/1990 | Vallee et al. | 568/26 |
| 4,937,385 | 6/1990 | Buchholz et al. | 568/26 |
| 5,068,445 | 11/1991 | Arretz | 568/21 |
| 5,093,017 | 3/1992 | Andress et al. | 252/46.7 |

FOREIGN PATENT DOCUMENTS

| | | | |
|---|---|---|---|
| 839767 | 4/1970 | Canada | 260/609.5 |
| 885990 | 11/1971 | Canada | 260/609.5 |
| 0025944 | 9/1980 | European Pat. Off. | 149/12 |
| 0337837 | 8/1990 | European Pat. Off. | 319/14 |
| 140063 | 8/1983 | Japan | 149/12 |
| 10559 | 1/1984 | Japan | 149/12 |
| 1160473 | 8/1969 | United Kingdom | 149/12 |

*Primary Examiner*—Ellen McAvoy
*Attorney, Agent, or Firm*—David E. LaRose

[57] ABSTRACT

This invention relates to additives for oleaginous fluids containing extreme pressure and antiwear agents and containing less than 15 GC area percent higher dialkyl polysulfides and to a process for their production comprising:

a) forming a first reaction mass comprising olefin, a sulfur source, and a catalyst;

b) heating the first reaction mass to a temperature and for a period of time which is sufficient to form a mixture of dialkyl disulfides, dialkyl trisulfides and higher dialkyl polysulfides;

c) forming a second reaction mass comprising the mixture of dialkyl disulfides, dialkyl trisulfides and higher dialkyl polysulfides formed in step (b), an organo phosphorus compound, and optionally an amine;

d) heating the second reaction mass to a temperature and for a period of time which are sufficient to convert at least a portion of the higher dialkyl polysulfides to dialkyl trisulfide; and e) recovering said mixed additive containing extreme pressure agents and antiwear agents, wherein said recovered mixed additive contains less than 15 GC area percent higher dialkyl polysulfides.

38 Claims, No Drawings

PROCESS FOR MIXED EXTREME PRESSURE ADDITIVES

BACKGROUND

This invention relates to additives for oleaginous fluids containing extreme pressure and antiwear agents and containing less than 15 wt. % higher dialkyl polysulfides and to a method for their manufacture.

Methods for preparing dihydrocarbyl polysulfides, such as dialkyl polysulfides based on the use of mercaptans and sulfur as raw materials are well known in the art and are described for example in U.S. Pat. Nos. 2,237,625, 3,022,351, 3,275,693, 3,308,166, 3,314,999, 3,340,321, 3,392,201, 3,452,100, 3,755,461, 3,994,979, 4,564,709, 4,876,389, 4,933,481, and 4,937,385; British Pat. Spec. No. 1,160,473; Canadian Pat. Nos. 839,767 and 885,990; European Pat. App. Pub. No. 25,944 and 337,837; and Japan Kokai (Laid-Open application) Nos. 58-140,063.

Another approach for producing dihydrocarbyl polysulfides involves oxidizing a mercaptan with air or free oxygen in the presence of a catalyst. In U.S. Pat. No. 2,558,221, the catalyst is a selected natural bauxite which contains on a weight basis 50–70% $Al_2O_3$, 8–20% $Fe_2O_3$, 2–8% $SiO_2$, 0.5–5% $TiO_2$, and 2–30% volatile matter as determined by ignition at 1800° F. In U.S. Pat. No. 2,574,884 the catalyst is alumina associated with a minor amount of vanadia, magnetic iron oxide or chromia. In U.S. Pat. No. 4,277,623 a catalyst system comprising a cobalt molybdate-alkali metal and/or alkaline earth metal hydroxide is used as the oxidation catalyst. And in U.S. Pat. No. 4,288,627 the oxidation catalyst is a supported cobalt molybdate catalyst used in combination with a liquid tertiary amine.

It is also known that dihydrocarbyl polysulfides can be formed by reacting mercaptans with sulfur chlorides such as sulfur monochloride and sulfur dichloride.

Of the various dihydrocarbyl polysulfides, dihydrocarbyl trisulfides are particularly desirable for use as extreme pressure lubricant additives because of their superior performance capabilities and their generally lower corrosiveness towards "yellow metals" such as copper. Higher hydrocarbyl polysulfides (e.g. polysulfides with more than about 3 sulfur atoms per molecule) are less desirable than polysulfides containing 3 or less sulfur atoms per molecule. Hence, one object of this invention is to provide a process which yields additives containing a high percentage of dihydrocarbyl di- and trisulfides and less higher dihydrocarbyl polysulfides.

Combinations of sulfur containing organic compounds and organo phosphorus compounds are described for example, in U.S. Pat. No. 3,583,915, wherein di(organo)phosphonates having the following structure

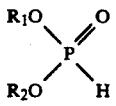

wherein $R_1$ and $R_2$ are individually alkyl or alkenyl groups having from 1 to 30 carbon atoms and at least one of which is an aliphatic group of at least 14 carbon atoms, are admixed with an active sulfur compound. Active sulfur compounds include organic sulfides and sulfurized hydrocarbons having up to 65% sulfur.

U.S. Pat. No. 3,510,426 describes lubricant compositions containing an alkyl phosphite and at least one sulfurized olefin selected from the group consisting of sulfurized butylenes and sulfurized cyclopentadiene. The lubricant compositions of this invention are said to have desirable extreme pressure properties.

U.S. Pat. No. 4,744,912 describes methods for the preparation of reaction products of sulfurized olefins, dialkyl hydrogen phosphites and primary alkyl amines as well as lubricant compositions containing same. Sulfurized olefins may be prepared, for example in accordance with U.S. Pat. Nos. 3,703,504 or 3,703,505. The dialkyl hydrogen phosphites have the general formula

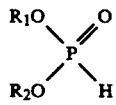

where each R is independently $C_1$ to about $C_{30}$ alkyl. The amines have the general formula $$R_3NH_2$$

wherein $R_3$ may be alkyl, aryl, alkaryl, aralkyl, cycloalkyl or substituted moieties thereof having from about 1 to about 30 carbon atoms, when aryl it contains from 6 to about 14 carbon atoms in the aryl group.

Japan Kokai 59-10559 describes a process wherein dialkyl polysulfide is treated with an aqueous solution of sodium sulfide or phosphine compound at 30°–80° C. for 1–5 hours. The dialkyl polysulfide type material is produced by reacting alkylmercaptan with sulfur to form a dialkyl trisulfide type material which is then treated to improve the copper corrosion properties. The treated product is indicated to have reduced copper corrosiveness; and the applicants, in that laid open application, express their belief that the reduction in copper corrosiveness is due to a chemical reaction whereby diakyl tetrasulfide and dialkyl pentasulfide are converted into a less corrosive diakyl trisulfide and sodium polysulfide, or triphenylphosphine sulfide and trilauryltrithiophosphine sulfide etc.

U.S. Pat. No. 4,900,460 relates to reaction products of dihydrocarbyl phosphates and phosphites and a particular sulfurized olefin and to lubricant compositions containing same. The sulfurized olefins are characterized as having no remaining olefinic bonds. The dihydrocarbyl phosphates and phosphites are reacted, in accordance with this invention, with sulfurized olefins in the absence of any added catalyst.

THE INVENTION

This invention involves, inter alia, the discovery that it is possible to prepare an essentially chlorine free additive mixture containing extreme pressure and anti-wear agents by treating the reaction product of olefin, a sulfur source, and a catalyst with an organo phosphorus compound and, optionally, an amine so as to yield the additive mixture comprising more than about 30 GC area % di-t-butyl trisulfide, from about 5 to about 30 GC area % di-t-butyl disulfide, from about 2 to about 40 GC area % hydrocarbyl thiophosphate or thiophosphine and less than 15 GC area % higher dialkyl polysulfides as determined by gas chromatographic (GC) analysis.

Among the desired characteristics of oleaginous compositions containing the additives of this invention is the ability of the compositions to exhibit extreme pressure and reduced wear properties under high-torque, low speed applications and to exhibit low corrosivity to copper containing metals.

A particulary key feature of the process of this invention is the substantial absence of halogens in the reactants and products thus formed. It is known that halogens in the presence of lubricating oils may lead to the formation of toxic compounds such as polyhalogenated bisphenols such as polychlorinated bisphenol (PCB). Due to the absence of halogens in the reactants and products of this invention, such polyhalogenated bisphenols are less likely to form. Other features of the invention will be evident from the ensuing description and appended claims.

Accordingly, this invention encompasses the preparation of an essentially chlorine free additive composition for oleaginous fluids containing extreme pressure and antiwear agents and containing less than 15 GC area % higher dialkyl polysulfides, wherein the additive is made by a process comprising: a) forming a first reaction mass comprising olefin, a sulfur source, and a catalyst; b) heating the first reaction mass to a temperature and for a period of time which is sufficient to form a mixture of dialkyl polysulfides; c) forming a second reaction mass comprising the mixture dialkyl polysulfides formed in step (b); an organo phosphorus compound; and, optionally, an amine; d) heating the second reaction mass to a temperature and for a period of time which are sufficient to convert at least a portion of the dialkyl polysulfides to dialkyl trisulfides; and e) recovering the additive composition containing extreme pressure and antiwear agents and containing less than 15 GC area % higher dialkyl polysulfides.

In a particulary preferred embodiment, this invention provides a process for preparing an essentially chlorine free additive mixture containing extreme pressure and anti-wear agents, the process comprising reacting the reaction product of (i) olefin, (ii) hydrogen sulfide, (iii) flowers of sulfur, and (iv) an alumina catalyst with a dibutyl hydrogen phosphite and an amine so as to yield an additive mixture comprising more than about 30 GC area % di-t-butyl trisulfide, from about 5 to about 30 GC area % di-t-butyl disulfide, from about 2 to about 60 GC area % of reaction product of amine and dibutylthiophosphate and less than 15 GC area % higher dialkyl polysulfides.

Olefins suitable for the process of this invention are the monoethylenically unsaturated aliphatic hydrocarbons referred to as aliphatic monoolefins containing 3 to about 12 carbon atoms. These include propylene, 1-butene, 2-butene, isobutene, 1-pentene, 2-pentene, 2-methyl-1-butene, 3-methyl-1-butene, 2-methyl-2-butene, 1-hexene, 2-hexene, 3-hexene, 2-methyl-1-pentene, 2-methyl-2-pentene, 2-ethyl-2-butene and the like including mixtures and oligomers thereof.

Preferably, the olefins are branched chain olefins such as isobutene, 2-methyl-1-butene, 1-methyl-2-butene, 2-methyl-2-pentene and the like. More preferably, the ethylenical double bond adjoins a tertiary carbon atom such as isobutylene, the most preferred olefin.

Sulfur sources include elemental sulfur in the form of precipitated sulfur or flowers of sulfur, alkali metal and alkaline-earth metal sulfides, hydrogen sulfide, and the like, or mixtures thereof. Use can be made, however, of any form or source of sulfur that is co-reactive with the olefin being used. While many different sources of sulfur may be used, it is less desirable to utilize sulfur compounds containing halides, as the sulfurized olefin products thus obtained may have to be further purified to reduce the halogen content of the product to a low level. Although powdered forms of sulfur are generally employed, it is possible to use molten sulfur. Particularly preferred sulfur sources include hydrogen sulfide or flowers of sulfur and most preferred is a combination of hydrogen sulfide and flowers of sulfur as the sulfur source.

The relative proportions of sulfur and hydrogen sulfide can be varied within relatively wide limits (e.g., from about 1:5 to about 1:0.5 gram atoms of sulfur per mol of hydrogen sulfide) to produce a wide variety of dihydrocarbyl polysulfides. When it is desired to form dihydrocarbyl trisulfide with high selectivity, a ratio of about 1:2 to about 1:1 gram atoms of sulfur per mol of hydrogen sulfide should be used.

The mole ratio of gram atoms of sulfur to olefin in the first reaction mass is another key feature of this invention. In general, the higher the ratio of sulfur to olefin, the higher the sulfur content of the dihydrocarbyl polysulfide product. Typically, the mole ratio of gram atoms of sulfur to olefin is less than about 1:1. When isobutylene is the olefin used, the mole ratio is more preferably, from about 0.1:1 to about 0.9:1 and most preferably, from about 0.5:1 to about 0.8:1.

In the first reaction mass, a reaction temperature is selected which is sufficient to form the mixture of dialkyl polysulfides from olefin and a sulfur source. Notably, the reaction temperature ranges from about 50° C. to about 200° C., preferably, from about 70° C. about 150° C., and most preferably, from about 100° C. to about 120° C.

At the above preferred reaction temperatures, the reaction will typically be conducted at superatmospheric pressures, especially when hydrogen sulfide is used as a sulfur source. Although the pressure is not critical to the process of the invention, a suitable pressure should be selected so that at least some, more preferably, substantially all of the reactants remain in the liquid phase. Desirably, the reaction pressure will range from about 2 atmospheres to about 70 atmospheres or higher.

Suitable catalysts may be acidic, basic or neutral. Useful neutral and acidic materials include acidified clays, p-toluenesulfonic acid, dialkylphosphorodithioic acids, phosphorus sulfides, such as phosphorus pentasulfide, and alumina catalysts. Basic catalysts include inorganic oxides and salts such as sodium hydroxide, calcium oxide, magnesium oxide, and sodium sulfide. Preferred catalysts are the alumina containing catalysts such as silica-alumina and aluminum oxide materials with aluminum oxide being the most highly preferred catalyst material.

Although an alumina containing catalyst is preferred, it is not known what catalyst transformations, if any, take place in situ during the reaction, and thus the identity of the actual catalytic species responsible for the reaction enhancement brought about by use of alumina is not known. The alumina catalyst typically remains active for an extended period of time; however, with repeated use, a portion of the catalyst may be deactivated during the reaction. Whatever its form, composition, and/or activity, this invention involves the use of any suitably active alumina catalyst in the process.

In a particulary preferred embodiment, the alumina catalyst is an activated alumina catalyst. The alumina catalyst may be activated by heating to an elevated temperature above 200° C. in a pressure vessel under an inert gas atomosphere, e.g. nitrogen, argon, helium, and the like. Such activated alumina catalysts typically have an average particle size in the range of from about 80 to about 200 mesh.

In another embodiment, the alumina catalyst is recycled from one run to the next. This procedure can be repeated, while augmenting the catalyst with fresh catalyst if necessary or desired, so long as the catalyst remains catalytically active in the process. When conducting the process with the objective in mind of forming dihydrocarbyl trisulfide with high selectivity, it is desirable to employ fresh catalyst or recycled catalyst which has not lost its ability to provide a product enriched in the trisulfide product. The number of times a given quantity of catalyst can be reused will depend on the characteristics of the particular catalyst selected for use and the particular reaction conditions under which it is used, but can be readily determined by the simple expedient of performing a few trial experiments in which the selected catalyst is recycled in a series of runs conducted under a selected set of reaction conditions.

The amount of catalytic material initially charged to the reaction vessel as aluminum oxide is generally in the range of from about 0.005 to about 0.1 moles per mole of olefinic compound charged. Preferably, the catalyst is charged such that the mole ratio of catalyst to olefin is in the range of from about 0.01:1 to about 0.06:1 moles of catalyst per mole of olefin, and most preferably, from about 0.03:1 to about 0.05:1 moles of catalyst per mole of olefin.

Reaction times generally fall in the range of about 0.5 to about 5 hours, and preferably are in the range of about 2 to about 3 hours. It is critical to the invention that the reaction mixture be stirred or subjected to other forms of physical agitation in order to insure intimate contact among the reactants and catalyst during the polysulfide formation reaction. Those skilled in the art will recognize that agitation speed sufficient to insure intimate contact among reactants will depend on the equipment size and total volume of reactants.

The order of addition of reactants to the first reaction mass is another key feature of the process of this invention. Preferably, solid sulfur and alumina catalyst are charged to the reaction vessel, and the reaction vessel is cooled to less than 10° C., preferably, less than 0° C., and most preferably to about −20° C. before charging the rest of the reactants. The order of addition of sulfur and alumina catalyst is not critical, however, to the invention. It is desirable, but not required to charge the hydrogen sulfide to the reaction vessel after charging the olefin to the reaction vessel in order to more easily control the reaction vessel pressure during reactant charging.

As the reaction proceeds, mercaptans generally form as a byproduct. The mercaptans along with excess hydrogen sulfide and olefin which are in the reaction vessel at the end of the first reaction are removed prior to forming the second reaction mass. Removal of the mercaptans, hydrogen sulfide, and olefin may be performed by methods well known by those skilled in the art. One method which may be used is to heat the mixture in the reaction vessel to about 40° C. and purge the vapor space above the mixture with an inert gas such as nitrogen, argon, helium, or the like. The means for removal of excess reactants and byproducts is not critical to the invention.

Notably, the first reaction can be conducted in the absence of a solvent. If it is desirable to use a solvent for the first reaction mixture, the solvent should be one in which the reactants are mutually soluble, and which can be easily removed at the end of the first reaction. The second reaction is most preferably conducted in the substantial absence of solvent.

When the first reaction is complete, a second reaction mass is formed by combining the mixture dialkyl polysulfides from the first reaction mass; an organo phosphorus compound; and, optionally, an amine. The combination of second reaction components can take place in the vessel containing the first reaction product or in a separate vessel. It is particularly desirable to utilize the product of the first reaction mass after removing substantially all of the catalyst, mercaptans, and excess reactants from the reaction product, but it is not necessary that the catalyst be removed.

The second reaction is conducted by heating the second reaction mass to a temperature and for a period of time which are sufficient to convert at least a portion of the dialkyl polysulfides to dialkyl trisulfides; and recovering the additive composition containing extreme pressure and antiwear agents and containing less than 15 GC area % higher dialkyl polysulfides.

Organo phosphorus compounds useful in the present invention include compounds represented by the following formulas

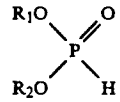
(I)

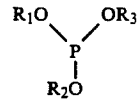
(II)

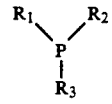
(III)

wherein each of $R_1$, $R_2$ and $R_3$ is hydrogen or a hydrocarbyl of 1 to 30 carbon atoms, preferably 1 to 10 carbon atoms with at least one of $R_1$ or $R_2$ being a hydrocarbyl group. The hydrocarbyl group may be saturated or unsaturated. More preferred are phosphites or phosphines containing two hydrocarbyl groups and most preferably, the phosphites are selected from di-R-hydrogen phosphites where R an $C_1$ to $C_{10}$ alkyl, aryl, cycloalkyl, aralkyl, alkaryl group or a mixture of any two of the foregoing groups. More preferably, R is an alkyl group, and most preferably R is a propyl, butyl, or pentyl group or a mixture of any two of the foregoing groups. Examples of phosphite suitable for use in the process of this invention include triethyl phosphite, tribuyl phosphite, triphenyl phosphite, di-n-butyl hydrogen phosphite, (DBHP), di-isobutyl hydrogen phosphite, di-isopropyl hydrogen phosphite, di-ethyl hydrogen phosphite, di-isooctyl hydrogen phosphite, di-ethylhexyl hydrogen phosphite, di-phenyl hydrogen phosphite and the like.

Phosphines used in the process of this invention are preferably selected from tri-$R_4$-phosphines wherein $R_4$ is an alkyl, aryl, or cycloalkyl group, or a mixture of two or three of the foregoing groups. More preferably, $R_4$ is an alkyl or an aryl or a mixture of alkyl and aryl groups, and most preferably $R_4$ is a phenyl group.

The amount of organophosphorus compound charged to the reaction mass should be sufficient to convert at least a portion of the higher dialkyl polysulfides to dialkyl-lower polysulfides such that the recovered additive mixture contains less than 15 GC area percent dialkyl-higher polysulfides. By dialkyl-lower polysulfides is meant, sulfides containing, on the average, three or less sulfur atoms per molecule. By dialkyl-higher polysulfides is meant sulfides containing, on the average, more than three sulfur atoms per molecule. In a particularly preferred embodiment, the mixed additive containing extreme pressure agents and antiwear agents comprises more than about 30 GC area percent dialkyl trisulfide; from about 5 to about 30 GC area percent dialkyl disulfide; from about 2 to about 60 GC area percent dialkylthiophosphate, or triarylthiophosphine; and less than about 15 GC area percent dialkyl-higher polysulfides.

In a particularly preferred embodiment, the amount of organophosphorus compound used in the second reaction ranges from about 0.05:1 to about 1.5:1 moles of organophosphorus compound per mole of polysulfide, preferably from about 0.1:1 to about 1:1 and most preferably, from about 0.3:1 to about 0.6:1 moles of organophosphorus per mole of polysulfide product from the first reaction mass.

The reaction temperature for the second reaction can vary within wide limits. Thus the temperature may range from below room temperature to above 100° C. It is particularly preferred however, to conduct the second reaction at a temperature ranging from about 40° C. to about 120° C., and most preferably from about 60° C. to about 100° C.

Reaction times will vary depending on the selected reaction temperature. In general, the second reaction proceeds rapidly. In most cases, the reaction will be complete in less than 10 hours, preferably, less than 4 hours, but may take longer depending on the volume of the reaction mass and the ability to maintain a reaction temperature within the desired range.

The reaction pressure for the second reaction is not critical to the invention. The pressure may range from subatmospheric to superatmospheric. It is desirable, however, to conduct the second reaction at substantially atmospheric pressure so that any mercaptans that form as a byproduct are easily removed by heating the reaction mass.

When di-n-butyl hydrogen phosphite is the selected phosphorus compound, it is particularly preferred to add an amine to the second reaction mass. In the case where an amine is used, the second reaction mass product will contain the reaction product of the selected amine and thiophosphate in addition to the mixture of dialkyl polysulfides thus formed.

Amines useful in the process of this invention include the primary, secondary and tertiary hydrocarbyl amines wherein the hydrocarbyl radicals are akyl, aryl, aralkyl, alkaryl or the like and contain about 1-30 carbon atoms. Preferably the amines are primary or secondary amines, and most preferably primary amines. The primary amines may be represented by the formula $$RNH_2$$

in which R is an aliphatic hydrocarbyl radical having from 1 to 26 carbon atoms. The preferred amines are those in which R is a branched chain alkyl radical having from about 10 to about 24 carbon atoms.

Examples of suitable amines include butylamine, amylamine, hexylamine, octylamine, laurylamine, tridecylamine, tetradecylamine, hexadecylamine, 2-ethylhexylamine, octadecylamine, and tricosylamine. Particularly preferred amines are 2-ethylhexylamine and certain commercially available mixtures of tertiary alkyl primary amines. For example, a mixture of tertiary alkyl primary amines in which the alkyl radical comprises a mixture of alkyl groups having 11 to 14 carbon atoms is available from Rohm & Haas under the trademark Primene 81-R amine. Another commercially available amine is the mixture of tertiary alkyl primary amines in which the alkyl radical comprises a mixture of alkyl groups having 18 to 24 carbon atoms which is available under the trademark Primene JM-T amine (Rohm & Haas). Other suitable amines include those known under the trademarks of Kemamine 999 (AKZO Chemie America), and Armeen 0L (Humko Chemical).

The second reaction is suitably conducted without the need for agitation. However, agitation can be used if desired. While the order of addition of reactants to the second reaction mass is not critical to the invention, it is preferred to add the mixture of polysulfides from the first reaction mass to a mixture of the organophosphorus compound and amine, when used.

The following examples illustrate, but are not intended to limit, embodiments of the present invention.

EXAMPLE 1

Polysulfides treated with tributyl phosphite

A mixture of polysulfides (1.5 grams) containing 67.1 GC area percent di-t-butyl trisulfide (S3) and 31.8 GC area percent di-t-butyl tetrasulfide (S4) was added to a 10 mL round-bottomed flask equiped with a condensor. To this mixture was added tributyl phosphite (TBP) (279 mg, 1.12 mmols) at 96° C. The temperature was raised as indicated in Table 1 and additional tributyl phosphite (921.7 mg, 3.70 mmols) was added after 80 minutes. The product was analyzed during the treatment by gas chromatographic (GC) analysis and yielded the indicated GC area percents of di-t-butyl disulfide (S2), di-t-butyl trisulfide (S3), di-t-butyl tetrasulfide (S4), tributyl phosphite (TBP), tributylthiophosphite (TBTP), and unidentified products (U). The treated product was colorless, and odor free and weighed 2.66 grams.

TABLE 1

| Time (min) | Temp (°C.) | S2 (area %) | S3 (area %) | S4 (area %) | TEP (area %) | TETP (area %) | U (area %) |
|---|---|---|---|---|---|---|---|
| 25 | 96 | 1.54 | 54.5 | 22.0 | 3.49 | 15.5 | 2.5 |
| 60 | 122 | 1.80 | 55.1 | 19.8 | 0.31 | 18.9 | 3.4 |
| 80 | 124 | — | — | — | — | — | — |
| 90 | 130 | 9.99 | 37.4 | 0.84 | 2.83 | 40.6 | 7.7 |
| 960 | 25 | 11.7 | 37.4 | 0.81 | 1.14 | 39.7 | 8.7 |

EXAMPLE 2

Polysulfides treated with triethyl phosphite

A mixture of polysulfides (1.5 grams) containing 67 GC area percent di-t-butyl trisulfide (S3) and 31 GC area percent di-t-butyl tetrasulfide (S4) was added to a 10 mL round bottomed flask equiped with a condensor.

To this mixture was added triethyl phosphite (TEP) (295 mg, 1.78 mmols) at 100° C. The temperature was raised as indicated in Table 2 and additional triethyl phosphite (339 mg, 2.04 mmols) was added after 40 minutes. The product was analyzed during the treatment by gas chromatographic (GC) analysis and yielded the indicated GC area percents of di-t-butyl disulfide (S2), di-t-butyl trisulfide (S3), di-t-butyl tetrasulfide (S4), triethyl phosphite (TEP), triethylthiophosphite (TETP), and unidentified products (U).

TABLE 2

| Time (min) | Temp (°C.) | S2 (area %) | S3 (area %) | S4 (area %) | TEP (area %) | TETP (area %) | U (area %) |
|---|---|---|---|---|---|---|---|
| 25 | 96 | 2.60 | 61.8 | 18.8 | 3.15 | 8.80 | 3.7 |
| 40 | 98 | — | — | — | — | — | — |
| 73 | 102 | 5.49 | 56.0 | 7.57 | 5.94 | 15.2 | 7.6 |
| 120 | 104 | 5.39 | 56.3 | 5.77 | 2.64 | 15.6 | 12.6 |
| 390 | 102 | 5.56 | 57.1 | 5.75 | 2.41 | 15.8 | 12.7 |

EXAMPLE 3

Polysulfides treated with triphenyl phosphite

A mixture of polysulfides (1.515 grams) containing 67.1 GC area percent di-t-butyl trisulfide (S3) and 31.8 GC area percent di-t-butyl tetrasulfide (S4) was added to a 10 mL round-bottomed flask equiped with a condensor. To this mixture was added triphenyl phosphite (TPP) (1.362 g, 0.44 mmols) at 100° C. The temperature was raised as indicated in Table 3. The product was analyzed during the treatment by gas chromatographic (GC) analysis and yielded the indicated GC area percents of di-t-butyl disulfide (S2), di-t-butyl trisulfide (S3), di-t-butyl tetrasulfide (S4), triphenyl phosphite (TPP), triphenyl-thiophosphite (TPTP), and unidentified products (U).

TABLE 3

| Time (hrs) | Temp (°C.) | S2 (area %) | S3 (area %) | S4 (area %) | TPP (area %) | TPTP (area %) | U (area %) |
|---|---|---|---|---|---|---|---|
| 0.7 | 104 | — | 49.7 | 14.2 | 26.9 | 6.4 | 2.68 |
| 5 | 102 | 0.44 | 52.8 | 9.0 | 23.1 | 10.8 | 2.74 |
| 20 | 105 | 2.51 | 63.9 | — | 10.2 | 15.6 | 7.70 |

EXAMPLE 4

Polysulfides treated with triphenyl phosphine

A mixture of polysulfides (1.51 grams) containing 67.1 GC area percent di-t-butyl trisulfide (S3) and 31.8 GC area percent di-t-butyl tetrasulfide (S4) was added to a 10 mL round-bottomed flask equipped with a condensor. To this mixture was added triphenyl phosphine ($Ph_3P$) (583 mg, 2.22 mmols) at 100° C. The temperature was raised to 122° C. and maintained at this temperature for about 80 minutes. A clear yellow solution was formed. Upon cooling, white needles precipitated. The precipitate was dissolved by addition of ethanol and the solution was analyzed by gas chromatographic (GC) analysis. The product contained 9.80 GC area percent of di-t-butyl disulfide (S2), 75.9 GC area percent of di-t-butyl trisulfide (S3), and 14.3 GC area percent of di-t-butyl tetrasulfide (S4). No unreacted triphenyl phosphine was detected in the product.

EXAMPLE 5

Polysulfides treated with triphenyl phosphine

Triphenyl phosphine (717 mg, 2.73 mmoles) was dissolved in 1.51 grams of the a mixture of polysulfides containing 67.1 GC area percent di-t-butyl trisulfide (S3) and 31.8 GC area percent di-t-butyl tetrasulfide (S4) in a 10 mL round-bottomed flask equipped with a condensor at 104° C. After about 30 minutes triphenylthiophosphine precipitated out of the mixture. Toluene (5.0 mL) was added to the mixture to dissolve the triphenylthiophosphine. Additional portions of triphenyl phosphine (TPP) were added to the mixture after 48 minutes (68 mg TPP); 68 minutes (71.6 mg TPP); and 90 minutes (275 mg TPP). The product was analyzed during the treatment by gas chromatographic (GC) analysis and yielded the indicated GC area percents of di-t-butyl disulfide (S2), di-t-butyl trisulfide (S3), and di-t-butyl tetrasulfide (S4).

TABLE 4

| Time (min) | S2 (area %) | S3 (area %) | S4 (area %) |
|---|---|---|---|
| 35 | 13.2 | 75.9 | 10.8 |
| 55 | 14.1 | 77.0 | 9.13 |
| 75 | 15.2 | 75.9 | 7.03 |
| 97 | 18.6 | 77.7 | 3.62 |

The following example was run to determine the effect temperature has on the reaction between the organophosphorus compound and the mixture of polysulfides.

EXAMPLE 6

Triphenylphosphine (714 mg, 2.72 mmols) and 1.51 grams of the a mixture of polysulfides containing 67.1 GC area percent di-t-butyl trisulfide (S3) and 31.8 GC area percent di-t-butyl tetrasulfide (S4) was dissolved in 10 mL of toluene. The clear solution was maintained at room temperature for 45 minutes. Analysis of the product after 45 minutes indicated 7.52 GC area percent di-t-butyl disulfide, 74.4 GC area percent di-t-butyl trisulfide, and 17 9 GC area percent di-t-butyl tetrasulfide. About 10 GC area percent triphenylphosphine was left unreacted.

EXAMPLE 7

Polysulfides treated with di-n-butyl hydrogen phosphite

Di-n-butyl hydrogen phosphite (0.78 mL, 4.0 mmols) and 2-ethylhexylamine (0.65 mL, 4.0 mmols) was added to 1.5 grams of a mixture of polysulfides containing 67.1 GC area percent di-t-butyl trisulfide (S3) and 3I.8 GC area percent di-t-butyl tetrasulfide (S4) in a 10 mL round-bottomed flask equiped with a condensor. The reaction mixture heated up slightly but cooled down to room temperature in about 10 minutes. Gas chromatographic (GC) analysis after 10 minutes reaction indicated 1.3 GC area percent disulfide, 95.2 GC area percent trisulfide, and 3.64 GC area percent tetrasulfide. The clear colorless solution was main-tained for 1 hour at room temperature. Analysis after 1 hour indicated 1.84 GC area percent disulfide, 97.64 GC area percent trisulfide, and 0.6 GC area percent tetrasulfide.

EXAMPLE 8

Polysulfides treated with di-n-butyl hydrogen phosphite

A 0.5 mL mixture of di-n-butyl hydrogen phosphite (DBHP) and 2-ethylhexylamine having a molar ratio of 1:2 DBHP:amine was added to 1.5 mL of a mixture of polysulfides containing 67.1 GC area percent di-t-butyl trisulfides (S3) and 31.8 GC area percent di-t-butyl tetrasulfides (S4) in a 10 mL round-bottomed flask equiped with a condensor. A second 0.5 mL portion of the 1:2 molar ratio of DBHP:amine was added to the mixture after an additional 22 minutes. The temperature of the mixture was raised to 98° C. and 0.25 mL of the 1:2 molar ratio of DBHP:amine was added after 26 minutes. Analysis of the product during and at the end of treatment is given in the following table.

TABLE 5

| Time (min) | S2 (area %) | S3 (area %) | S4 (area %) |
|---|---|---|---|
| 8 | — | 72.3 | 27.6 |
| 15 | — | 76.5 | 23.5 |
| 26 | 1.02 | 96.0 | 3.1 |

EXAMPLE 9

Polysulfides treated with di-n-butyl hydrogen phosphite

A mixture of polysulfides (20 grams, 23 mL) having 17.1 GC area percent disulfide, 44.1 GC area percent trisulfide, and 31.1 GC area percent tetrasulfide was put in a round-bottomed flask which was placed in an oil bath at 88° C. A mixture having a 1:1 molar ratio of DBHP (38.84 grams) and 2-ethylhexylamine (25.85 grams) was then added in the amounts and at the intervals indicated in Table 6. After 2 hours, the mixture was left at room temperature for the remainder of the time period. Gas chromatographic analysis was used to indicate the change in the ratio of trisulfides to tetra-sulfides (S3/S4) as the reaction progressed.

TABLE 6

| Time | DBHP/Amine (mL) | S3/S4 |
|---|---|---|
| 0 | 3 | — |
| 5 min | — | 1.35 |
| 8 min | 5 | — |
| 20 min | — | 1.39 |
| 40 min | 6.5 | 1.55 |
| 60 min | — | 3.55 |
| 82 min | — | 3.24 |
| 85 min | 4 | — |
| 2 hrs | — | 6.51 |
| 19 hrs | — | 9.7 |
| 19.25 hrs | 1.5 | 10.9 |
| 19.5 hrs | — | 10.3 |
| 20.25 hrs | 3 | — |
| 20.6 hrs | — | 20.2 |

The following example illustrates the copper corrosiveness of polysulfides treated with organophosphorus compounds to reduce the amount of higher polysulfides in the mixture.

EXAMPLE 10

A mixture of polysulfides (10 mL) having 17.1 GC area percent disulfide, 44.1 GC area % trisulfide, and 31.1 GC area percent tetrasulfide was treated with different amounts of a 1:1 mixture based on volume of DBHP and Primene 81-R amine at 85°-90° C. for 1 hour. The resulting mixtures where then submitted to copper corrosion test analysis (CCT) whereby a clean copper strip (6 cm square, 3 5 grams) was heated in 15 grams of the resulting polysulfide mixture at a temperature of 122° C. for 3 hours. The copper sample is then re-weighed and the results of such treatment are given in Table 7 as milligrams of copper lost from the sample.

TABLE 7

| DBHP/Amine (mL) | S3/S4 | CCT (mg. lost) |
|---|---|---|
| 1.0 | 1.33 | 239.7 |
| 3.0 | 1.55 | 165.3 |
| 7.0 | 2.58 | 54.1 |
| 10.0 | 5.99 | 40.2 |

The following example illustrates the preparation of polysulfides from olefin, hydrogen sulfide and sulfur.

EXAMPLE 11

Preparation of di-t-butyl polysulfide

A solid mixture of flowers of sulfur (8.56 grams, 0.268 gram-atoms) and alumina (2.00 grams, 0.020 mol) was placed in a 150 mL stainless steel autoclave. The autoclave was sealed and the pressure was lowered with a vacuum pump. Isobutylene (30 grams, 0.54 mol) and $H_2S$ (26 grams, 0.76 mol) were charged to the reactor which was placed in a dry-ice/acetone cooling bath. After warming in luke warm water, the reactor was heated to 105°-110° C. in 10 min. The pressure at this temperature was 6.5 MPa which dropped to 4.5 MPa as the reaction progressed. The reaction mixture was stirred for a total of 3 hours. At the end of the 3 hour period, the temperature was lowered to 80° C. and the pressure was released over a 30 minute period into a line of traps comprising dry-ice/acetone, dilute NaOH and bleach. The temperature was further lowered to 60° C. and t-butyl mercaptan was removed from the product by bubbling nitrogen into the mixture. A product in the form of light yellow oil (26.2 grams) gave the following GC area percent composition:

| Component | GC Area % |
|---|---|
| t-butyl mercaptan | 0.74 |
| di-t-butyl sulfide | 1.06 |
| di-t-butyl disulfide | 29.3 |
| di-t-butyl trisulfide | 49.8 |
| di-t-butyl tetrasulfide | 14.6 |
| unidentified products | 2.3 |

EXAMPLE 12

Polysulfides treated with di-n-butyl hydrogen phosphite

A mixture of polysulfides (20.0 grams) from Example 11 was added to a 1:1 volume to volume (3 mL each) mixture of DBHP and Primene 81R amine. The clear solution was heated to 70°-75° C. for the first three hours. Another 6 mL of reagent was added after 3.2 hours. Table 8 tabulates the polysulfide compositions as GC area percentages for samples taken in the course of the reaction. "U" represents unidentified products.

TABLE 8

| Time (hrs.) | S2 | S3 | S4 | U | S3/S4 |
|---|---|---|---|---|---|
| 0 | 29.3 | 49.8 | 14.6 | 2.3 | 3.4 |
| 0.5 | 30.1 | 54.8 | 13.4 | 1.7 | 4.1 |
| 1.25 | 30.0 | 56.0 | 11.8 | 1.8 | 4.7 |
| 3.0 | 29.4 | 56.8 | 10.3 | 3.0 | 5.5 |
| 3.2 | — | — | — | — | — |
| 4.5 | 28.8 | 63.5 | 4.77 | 2.9 | 13.3 |
| 24 | 28.1 | 67.9 | 2.83 | 1.1 | 24.0 |

The following example illustrates the influence of the molar ratio of amine to phosphite on the reaction rate.

EXAMPLE 13

Di-t-butyl polysulfide (5 mL, 76.1 GC area percent trisulfide (S3), and 22.2 GC area percent tetrasulfide (S4)) was added to a mixture of 6.66 mmol of dibutyl hydrogen phosphite (DBHP) and 2-ethylhexylamine (EHA) in a quantity determined by the ratio given in the table. The reaction mass was held for 2 hours at 90° C.

TABLE 9

| Sample | EHA:DBHP (mol ratio) | Time (min.) | GC Area Percentage S3 | S4 | S3/S4 |
|---|---|---|---|---|---|
| 1 | 1:1 | 60 | 93.1 | 5.2 | 15.6 |
| | | 120 | 94.4 | 4.5 | 20.9 |
| 2 | 2:1 | 60 | 96.8 | 2.2 | 29.2 |
| | | 120 | 97.7 | 1.3 | 59.2 |
| 3 | 1:2 | 60 | 85.3 | 14.0 | 6.1 |
| | | 120 | 86.0 | 13.1 | 6.6 |
| 4 | 1:4 | 60 | 80.0 | 20.0 | 4.0 |
| | | 120 | 81.6 | 18.4 | 4.4 |

EXAMPLE 14

This example illustrates the effect of temperature on the reaction rate. Di-t-butyl polysulfide (5 mL, 76.1 GC area percent trisulfide (S3), 22.2 GC area percent tetrasulfide (S4) was used.

TABLE 10

| Sample | Temp. (°C.) | DBHP (mmol) | EHA (mmol) | Time (hrs) | GC Area Percentage S2 | S3 | S4 | S3/S4 |
|---|---|---|---|---|---|---|---|---|
| 1 | 90 | 6.66 | 3.33 | 1 | — | 85.3 | 14.0 | 6.10 |
| | | | | 2 | — | 86.0 | 13.1 | 6.56 |
| 2 | 135-140 | 6.66 | 3.33 | 1 | 0.69 | 86.9 | 12.3 | 7.03 |
| | | | | 2 | 0.79 | 87.7 | 11.5 | 7.61 |
| 3 | 180 | 6.66 | 3.33 | 1 | 2.30 | 87.6 | 9.76 | 8.31 |
| | | | | 2 | 4.91 | 87.7 | 7.43 | 11.8 |
| 4 | 130 | 13.20 | 26.70 | 1 | — | 93.4 | 6.4 | 14.7 |
| | | | | 1.5 | 1.30 | 98.7 | — | — |
| | | | | 20 | 2.60 | 97.4 | — | — |

The following Example illustrates the use of different amines in the reduction of tetrasulfides with BDHP.

EXAMPLE 15

Di-t-butyl polysulfide (5 mL, 76.1 GC area percent trisulfide (S3), 22.2 GC area percent tetrasulfide (S4)) was added to a 1:1 mixture of DBHP (6.66 mmol) and the amines indicated in the table. The mixture was held at 90° C. for the times indicated.

TABLE 11

| Sample | Amine | Time (min) | GC Area Percentage S3 | S4 | S3/S4 |
|---|---|---|---|---|---|
| 1 | 2-ethylhexylamine | 5 | 90.3 | 9.7 | 9.36 |

TABLE 11-continued

| Sample | Amine | Time (min) | GC Area Percentage S3 | S4 | S3/S4 |
|---|---|---|---|---|---|
| | | 60 | 93.1 | 5.2 | 15.6 |
| 2 | 4-t-butylaniline | 5 | 78.0 | 22.0 | 3.55 |
| | | 60 | 77.0 | 23.0 | 3.34 |
| 3 | N,N-di-n-butylaniline | 5 | 77.9 | 22.1 | 3.53 |
| | | 65 | 78.1 | 21.9 | 3.57 |
| 4 | diisobutylamine | 5 | 80.4 | 19.6 | 4.1 |
| | | 60 | 90.9 | 9.1 | 9.96 |
| 5 | di-2-ethylhexylamine | 5 | 78.8 | 21.2 | 3.73 |
| | | 60 | 86.0 | 14.0 | 6.12 |
| 6 | tri-n-propylamine | 5 | 77.5 | 22.5 | 3.49 |
| | | 60 | 82.4 | 17.6 | 4.68 |
| | | 120 | 89.0 | 11.0 | 8.12 |
| 7 | tri-n-octylamine | 5 | 78.3 | 21.7 | 3.6 |
| | | 60 | 85.1 | 14.9 | 5.73 |
| | | 120 | 88.4 | 11.6 | 7.59 |
| 8 | primene 81R | 16 | 87.6 | 12.4 | 7.09 |
| | | 90 | 91.8 | 8.23 | 11.1 |

The following Examples illustrate the use of different phosphites in the reduction of tetrasulfides with EHA.

EXAMPLE 16

Di-t-butyl polysulfide (5 mL, 76.1 GC area percent trisulfide (S3), 22.2 GC area percent tetrasulfide (S4)) was added to a 1:1 mixture of EHA (861 mg, 6.66 mmol) and phosphite (6.66 mmol). Phosphites used in this example were di-n-butyl hydrogen phosphite (DBHP), diethyl hydrogen phosphite (DEHP), and diphenyl phosphite (DPHP). The mixture was held at 90° C. for the times indicated.

TABLE 12

| Sample | Phosphite | Time (min) | GC Area Percent S4 | S3/S4 | A[1] | B[2] | C[3] |
|---|---|---|---|---|---|---|---|
| 1 | DBHP | 5 | 9.7 | 9.36 | 46 | 3.0 | 3.6 |
| | | 24 | 7.3 | 12.6 | 26 | 3.5 | 5.0 |
| | | 60 | 5.2 | 15.6 | 13 | 3.9 | 5.8 |
| | | 120 | 4.5 | 20.9 | 17 | 4.1 | 5.5 |
| | | 20 (hrs) | 2.7 | 35.6 | <5 | 4.5 | >6.3 |
| 2 | DEHP | 5 | 10.4 | 8.65 | 14 | 2.8 | 5.7 |
| | | 15 | 7.0 | 13.3 | 9 | 3.5 | 6.1 |
| | | 60 | 5.4 | 17.7 | 5 | 3.9 | 6.3 |
| 3 | DPHP[4] | 5 | 16.2 | 5.15 | 9 | 1.4 | 6.1 |
| | | 22 | 12.4 | 7.06 | 5 | 2.3 | 6.3 |
| | | 44 | 12.0 | 7.34 | 4 | 2.4 | 6.4 |
| | | 63 | 11.8 | 7.50 | 4 | 2.4 | 6.4 |
| | | 120 | 11.6 | 7.58 | 5 | 2.4 | 6.3 |

[1]A = percent unreacted phosphite
[2]B = mmols tetrasulfide reduced to trisulfide
[3]C = mmols phosphite reacted
[4]DPHP was a commerical mixture containing diphenyl phosphite (66 GC area %), triphenyl phosphite (4.8 GC area %), phenol (26 GC area %), other impurities (3.2 GC area %).

Other embodiments of the invention are within the spirit and scope of the appended claims.

What is claimed is:

1. A method for preparing an essentially chlorine free mixed additive containing extreme pressure agents and antiwear agents for oleaginous fluids, wherein said additive contains less than 15 GC area percent higher dialkyl polysulfides, said process comprising:

a) forming first reaction mass comprising olefin, a sulfur source, and a catalyst;

b) heating the first reaction mass to a temperature and for a period of time which are sufficient to form a mixture of dialkyl disulfides, dialkyl trisulfides and higher dialkyl polysulfides;

c) forming a second reaction mass comprising the mixture of dialkyl disulfides, dialkyl trisulfides and higher dialkyl polysulfides formed in step (b), an organo phosphorus compound, and optionally an amine;

d) heating the second reaction mass to a temperature and for a period of time which are sufficient to convert at least a portion of the higher dialkyl polysulfides to dialkyl trisulfide; and e) recovering said mixed additive containing extreme pressure agents and antiwear agents, wherein said recovered mixed additive contains less than 15 GC area percent higher dialkyl polysulfides wherein the sulfur source is a mixture of hydrogen sulfide and flowers of sulfur.

2. The method of claim 1 wherein the olefin is isobutylene.

3. The method of claim 2 wherein the mole ratio of gram atoms of sulfur to isobutylene in the first reaction mass is in the range of from about 0.5:1 to about 0.8:1.

4. The method of claim 1 wherein the catalyst is an activated alumina catalyst.

5. The method of claim 1 wherein the higher dialkyl polysulfides is a mixture of dialkyl($S_4$–$S_7$) polysulfides.

6. The method of claim 1 wherein the dialkyl trisulfide is di-t-butyl trisulfide.

7. The method of claim 1 wherein the organo phosphorus compound is a phosphine or phosphite.

8. The method of claim 1 wherein the organo phosphorus compound is triphenylphosphine.

9. The method of claim 1 wherein the organo phosphorus compound is triphenyl phosphite.

10. The method of claim 6 wherein the organo phosphorus compound is dibutyl hydrogen phosphite.

11. The method of claim 10 wherein the second reaction mass contains a primary amine.

12. The method of claim 11 wherein the primary amine is 2-ethylhexylamine.

13. The method of claim 11 wherein the primary amine is Primene 81-R amine.

14. The method of claim 12 wherein the recovered mixed additive comprises from about 30 to about 70 GC area percent di-t-butyl trisulfide and from about 2 to about 40 GC area percent of a reaction product of higher di-t-butyl polysulfides amine and dibutyl hydrogen phosphite.

15. The method of claim 14 wherein the recovered mixed additive contains less than about 6 GC percent area higher dialkyl polysulfides.

16. An essentially chlorine free additive composition for oleaginous fluids containing extreme pressure and antiwear agents and containing less than 15 GC area percent higher dialkyl polysulfides, said additive made by a process comprising:

a) forming a first reaction mass comprising olefin, a sulfur source, and a catalyst;

b) heating the first reaction mass to a temperature and for a period of time which are sufficient to form a mixture of dialkyl polysulfides;

c) forming a second reaction mass comprising the mixture dialkyl polysulfides formed in step (b); an organo phosphorus compound; and optionally, an amine;

d) heating the second reaction mass to a temperature and for a period of time which are sufficient to convert at least a portion of the dialkyl polysulfides to dialkyl trisulfide; and e) recovering said additive composition containing extreme pressure and antiwear agents and containing less than 15 GC area percent higher dialkyl polysulfides wherein the sulfur source is a mixture of hydrogen sulfide and flowers of sulfur.

17. The composition of claim 16 wherein the olefin is isobutylene.

18. The composition of claim 17 wherein the mole ratio of gram atoms of sulfur to isobutylene in the first reaction mass is in the range of from about 0.5:1 to about 0.8:1.

19. The composition of claim 16 wherein the catalyst is an activated alumina catalyst.

20. The composition of claim 16 wherein the higher dialkyl polysulfides is a mixture of dialkyl($S_4$–$S_7$) polysulfides.

21. The composition of claim 16 wherein the dialkyl trisulfide is di-t-butyl trisulfide.

22. The composition of claim 16 wherein the organo phosphorus compound is a phosphine or phosphite.

23. The composition of claim 16 wherein the organo phosphorus compound is triphenyl phosphine.

24. The composition of claim 16 wherein the organo phosphorus compound is triphenyl phosphite.

25. The composition of claim 21 wherein the organo phosphorus compound is dibutyl hydrogen phosphite.

26. The composition of claim 25 wherein the second reaction mass contains a primary amine.

27. The composition of claim 26 wherein the primary amine is 2-ethylhexylamine.

28. The composition of claim 26 wherein the primary amine is Primene 81-R amine.

29. The composition of claim 27 wherein the recovered additive composition comprises from about 30 to about 70 GC area percent di-t-butyl trisulfide and from about 2 to about 60 GC area percent of a reaction product of higher di-t-butyl polysulfides amine and dibutyl hydrogen phosphite.

30. The composition of claim 29 wherein the recovered additive composition contains less than about 6 GC area percent higher dialkyl polysulfides.

31. A process for preparing an essentially chlorine free additive mixture containing extreme pressure and antiwear agents, said process comprising reacting the reaction product of (i) olefin, (ii) hydrogen sulfide, (iii) flowers of sulfur, and (iv) an alumina catalyst with a dibutyl hydrogen phosphite and an amine so as to yield an additive mixture comprising more than about 30 GC area percent di-t-butyl trisulfide, from about 5 to about 30 GC area percent di-t-butyl disulfide, from about 2 to about 40 GC area percent of a reaction product of higher di-t-butyl polysulfide amine and dibutyl hydrogen phosphite and less than 15 GC area percent higher dialkyl polysulfides.

32. The process of claim 31 wherein the olefin is isobutylene.

33. The process of claim 32 wherein the mole ratio of gram atoms of sulfur to isobutylene in the first reaction mass is in the range of from about 0.5:1 to about 0.8:1.

34. The process of claim 33 wherein the amine is a primary amine.

35. The process of claim 34 wherein the primary amine is 2-ethylhexylamine.

36. The process of claim 34 wherein the primary amine is Primene 81-R amine.

37. The process of claim 35 wherein the higher dialkyl polysulfides is a mixture of dialkyl($S_4$–$S_7$) polysulfides.

38. The process of claim 37 wherein the recovered additive mixture contains less than about 6 GC area percent higher dialkyl polysulfides.

* * * * *